US006907326B1

(12) United States Patent
Kucik

(10) Patent No.: US 6,907,326 B1
(45) Date of Patent: Jun. 14, 2005

(54) AUTONOMOUS SURF ZONE LINE CHARGE DEPLOYMENT SYSTEM

(75) Inventor: Daniel P. Kucik, Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/156,370

(22) Filed: May 28, 2002

(51) Int. Cl.[7] ..... G06F 17/00

(52) U.S. Cl. ..... 701/23; 701/200; 701/301; 701/21; 701/24; 701/25; 701/26; 701/36; 701/1; 114/255; 114/1; 114/312; 114/18; 114/258; 114/44; 114/56.1; 114/343; 114/382; 180/271; 441/136; 340/901; 340/984; 340/985; 166/241.1; 166/352; 166/353; 166/354; 166/355; 166/356

(58) Field of Search ..... 102/401, 293, 102/403; 89/1.13, 37.1, 1.1, 1.11; 701/23, 1, 21, 24, 25, 26, 36, 200, 301; 114/255, 1, 312, 18, 258, 44, 56.1, 343, 382; 180/271; 340/901, 984, 985; 441/136; 166/241.1, 352, 353, 354, 355, 356

(56) References Cited

U.S. PATENT DOCUMENTS 4,275,973 A * 6/1981 Aubert ..... 405/86
5,547,327 A * 8/1996 Bachalo et al. ..... 414/137.1
5,708,230 A * 1/1998 Woodall et al. ..... 102/402
5,792,978 A * 8/1998 Woodall et al. ..... 102/403
5,960,732 A * 10/1999 Peterson ..... 114/244
6,003,463 A * 12/1999 Giesler ..... 114/259
6,217,607 B1 * 4/2001 Alt ..... 623/1.1
6,508,188 B2 * 1/2003 Dong et al. ..... 114/67 R

* cited by examiner

*Primary Examiner*—Olga Hernandez
(74) *Attorney, Agent, or Firm*—James T. Shepherd

(57) ABSTRACT

A system and method autonomously clears obstacles and mines from an approach lane. A ship is distantly located from an approach lane spanning a surf zone and beach portion, and the ship has operator control station software in an onboard computer. At least one system delivery vehicle having a storage bay and propulsion system transits from the ship to the approach lane in response to instructions from the operator control station. A line charge is disposed in each bay and has one end coupled to the system delivery vehicle. A line charge delivery vehicle in the bay is connected to another end of the line charge to pull the line charge from the bay and emplace it in a straight path in the approach lane in response to instructions from the operator control station. Explosives in all line charges are detonated to clear the approach lane.

21 Claims, 4 Drawing Sheets

| FIG. 1B | FIG. 1A |
|---|---|

AUTONOMOUS SURF ZONE LINE CHARGE DEPLOYMENT SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to clearing mines and other obstacles from an area. More particularly, this invention is to an autonomous system deploying at least one line charge to clear an approach lane.

Access to regions held by hostile forces could require an amphibious assault through an approach lane that extends from the sea and across a beach. Prior to the amphibious assault, mines and obstacles should be cleared from the approach lane so that landing craft can safely make the assault. A more challenging part of this task is the clearance of the surf zone portion of the lane (from 10 to 0 feet of water depth) because of highly dynamic and unforgiving wave action, currents, etc.

Divers in demolition/assault teams have performed this task but they must bring in a substantial amount of explosive charges. By itself carrying in this load is formidable, however, the significant hazards in the dynamic surf zone additionally must be dealt with. During deployment, the demolition teams and the explosive charges often are in exposed positions. This could attract unwanted attention and draw concentrated defensive fires from entrenched, determined defenders. The extreme peril created during manned clearing operations usually means that casualties may have to be sustained among the members of these highly trained teams, and even at this cost, the success of such missions may still be in doubt.

Rocket deployed line charges have been used with some success. But, they usually are launched from exposed positions adjacent to a target area, and neutralization of all mines and obstacles in an area is not assured since the rocket deployed line charges do not always accurately and uniformly cover a designated area satisfactorily.

Thus, in accordance with this inventive concept, a need has been recognized in the state of the art for an autonomous method and means for clearing mines and other obstacles from an approach lane that reduces the hazards to personnel yet assures successful completion of the mission.

OBJECT AND SUMMARY OF THE INVENTION

An object of the invention is to provide an autonomous system to deploy at least one explosive line charge to neutralize mines and obstacles in an approach lane.

Another object of the invention is to provide an autonomous system to deploy at least one explosive line charge to neutralize mines and obstacles in an approach lane extending through the surf zone and partially onto the beach.

Another object of the invention is to provide an autonomous system to neutralize mines and obstacles in an approach lane that reduces the exposure of personnel to danger.

Another object of the invention is to provide an autonomous system to neutralize mines and obstacles in an approach lane to reduce the exposure of personnel to danger and using at least one line charge that can be partially deployed, further deployed, and detonated in a spacedapart sequence.

Another object of the invention is to provide an autonomous system to neutralize mines and obstacles in an approach lane having a buoyancy means on line charges to aid deployment through the surf zone and partially onto the beach.

These and other objects of the invention will become more readily apparent from the ensuing specification when taken in conjunction with the appended claims.

Accordingly, the present invention is to an autonomous system and method for deployment of a line charge extending through a surf zone and/or partially across a beach to clear mines and obstacles from an approach lane. A ship is distantly located from an approach lane spanning a surf zone and a beach portion, and the ship has software of an operator control station in an onboard computer. At least one system delivery vehicle having a storage bay and propulsion means transits from the ship to the approach lane in response to first instructions from the operator control station. A line charge is disposed in each bay and has one end coupled to the system delivery vehicle. A line charge delivery vehicle in each bay is connected to another end of the line charge to pull the line charge from the bay and emplace it in a straight path in the approach lane in response to second instructions from the operator control system. Explosives in all line charges are detonated to clear the approach lane.

DESCRIPTION OF THE PREFERRED EMBODIMENTS

Figures 1, 1A:
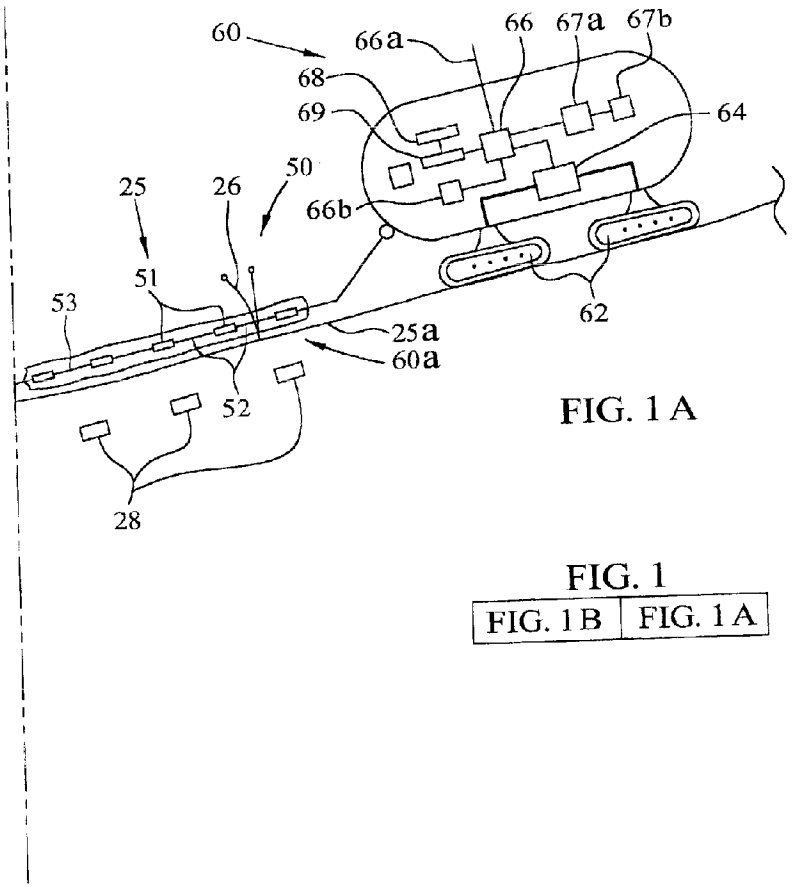
FIG. 1 is a schematic side view, partially in cross section of constituents of the autonomous system of the invention for clearing mines and obstacles in an approach lane extending through the surf zone and partially across a beach.
Figure 1B:
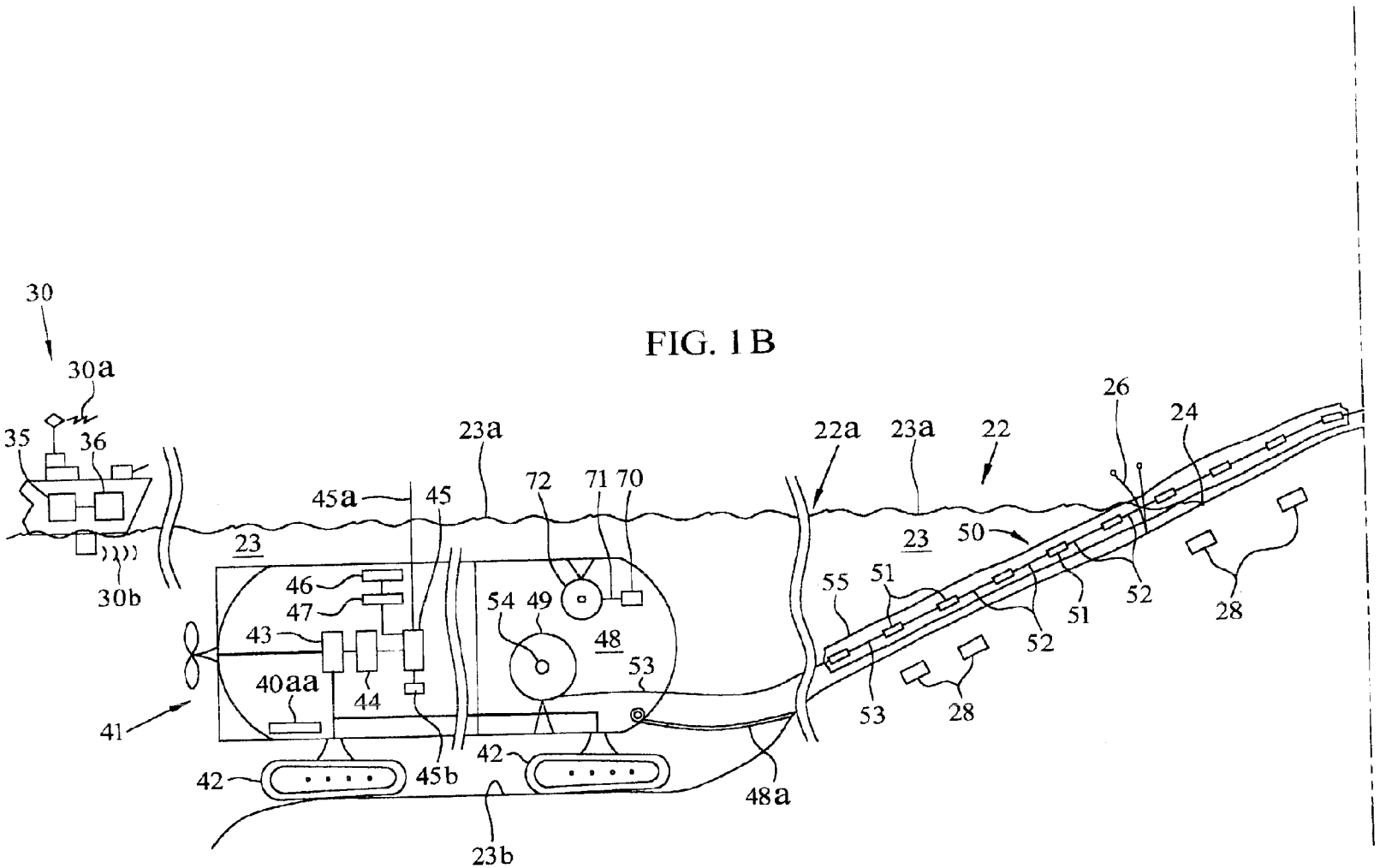

Referring to FIG. 1, an autonomous line charge deployment system 10 of the invention has the capability to be deployed from over-the-horizon to where an amphibious assault can be made. The goal of most amphibious assaults is to gain a beachhead on a landmass and go through what is called an approach lane 20. Approach lane 20 can include a surf zone 22 under water 23 (from ten to zero feet of water depth), shoreline 24, and beach portion 25 of sand, sediment, dirt, etc. Conducting a successful amphibious assault usually requires clearance of obstacles 26 and mines 28 from both surf zone 22 and beach portion 25 of approach lane 20 to allow safe passage of personnel, materials, and vehicles.

Autonomous deployment system 10 has an over-the-horizon support ship 30, at least one system delivery vehicle (SYSDV) 40, at least one line charge 50, and at least one line charge delivery vehicle (LCDV) 60. Autonomous deployment system 10 of the invention allows selective, controlled clearing of an area, or approach lane 20 with at least one line charge 50. Only one SYSDV 40, line charge 50, and LCDV 60 are shown in FIG. 1, it being understood that many of these combinations, to be described, may be needed to clear a wider approach lane 20. Autonomous deployment system 10 reduces casualties during placement and detonation of line charge 50 by keeping personnel out of a possibly hotly contested beach region and instead, using their talents at a safer remote location on ship 30, possibly over-the-horizon to plan and execute clearing operations.

Support ship 30 is the staging area of system 10 and has a software control package, or operator control station (OCS) 35 running on laptop computer 36. OCS 35 is used to plan and execute line deployment missions and allows an operator at a distant command station or at ship 30 to analyze the information of latitudes/longitudes representing the area to be cleared and monitor system status and progress. In accordance with software package of OCS 35 laptop computer 36 can display maps of the area indicating the lane to be cleared in order to confirm the information provided by the operator. Software of OCS 35 on laptop 36 tells the operator the number of SYSDV 40s and LCDV 60s pulling line charges 50 that must be deployed in order to clear the area of approach lane 20.

Next, the software of OCS 35 will initialize each SYSDV 40 and LCDV 60 and provide first instructions 46, or software on a first single board computer 47 in each SYSDV 40 and second instructions 68, or software on a second single board computer 69 in each LCDV 60. First instructions 46 in first computer 47 in each SYSDV 40 effect responsive operation of that SYSDV 40. For example, first instructions 46 from OCS 35 can control where each SYSDV 40 should deploy its associated LCDV 60. Second instructions 68 in second computer 69 in each LCDV 60 effect operation of that LCDV 60 in response to second instructions 68. For example, second instructions 68 can control the elongate path 60*a* each LCDV 60 should traverse to emplace its interconnected line charge 50 along that path 60*a*.

From laptop computer 36 in ship 30 first and second instructions 46, 68 in first and second computers 47, 69 make each SYSDV 40 and its associated LCDV 60 autonomous by providing destination/path and obstacle avoidance instructions. First and second instructions 46, 68 can also tell each SYSDV 40 where the deployment destination of line charge 50 by each LCDV 60 is and where each LCDV 60's path 60*a* through approach lane 20 is. Accordingly, after each SYSDV 40 is launched, it automatically proceeds to the designated area for deployment of its payload, (LCDV 60 and its line charge 50), and completion of the mission.

At least one SYSDV 40 and LCDV 60 can have a remote control capability responsive to, for example, electromagnetic control signals 30*a* and/or acoustic control signals 30b transmitted from ship 30, or another remote station to allow remote control of SYSDV 40 and LCDV 60. Additional communications capabilities can be included in communication/control modules 45 and modules of navigational equipment 66 that interface with antennas 45*a*, 66*a* and transducers 45*b*, 66*b* for SYSDV 40 and LCDV 60, respectively. The remote control capability can be a desirable feature when tactical scenarios change.

SYSDV 40 of autonomous deployment system 10 can be deployed many miles from ship 30 to the seaward edge 22*a* of surf zone 22 where at least one line charge 50 is to be deployed. SYSDV 40 can have one or more propulsion means having propeller/control fin structures 41 as a swimmer delivery vehicle and/or having several tracked crawler assemblies 42 as a ground crawler vehicle similar to a heavy equipment, earth moving vehicle to propel and steer SYSDV 40 through water 23 from ship 30. Propeller/control fin structures 41 are more likely to be selected for guided propulsion of SYSDV 40 over long distances or rough marine topography.

Each SYSDV 40 can be relatively large since it must transport considerable equipment and a bulky and heavy payload (LCDV 60 and line charge 50). SYSDV 40 has propulsion and guidance motors 43 and fuel and/or battery supply 44 for propeller/control fin structures 41 and tracked ground crawler assemblies 42. Communications/control modules 45 are connected to structures 41 and assemblies 42 via motors 43 and are connected to single board computer 47. Single board computer 47 can have the capacity of a desktop computer and has software 46 that is responsive to OCS 35 when each computer 47 of each SYSDV 40 is coupled to laptop computer 36 aboard ship 30. This responsive software 46 entered into computer 47 allows it to generate proper control signals for communications/control modules 45 to get SYSDV 40 to its intended destination while avoiding any obstacles that might be encountered during the transit. En route to the intended destination, corrections and/or changes in course can be made via communications/control modules 45. Modules 45 additionally have a navigational payload system to receive electromagnetic signals via antenna 45*a* from the global positioning system (GPS, DGPS, GPS with WAAS) and/or a long baseline acoustic navigational system to receive acoustic signals via acoustic transducers 45*b* and generate appropriate control signals to keep SYSDV 40 on course or change to a different destination as a tactical situation changes.

Each SYSDV 40 has a spacious storage bay 48 that can be selectably opened and closed by a hinged cover 48a. Storage bay 48 contains a high-capacity reel 49 having a line charge 50 coiled on it and a line charge delivery vehicle (LCDV) 60. Optionally, when a system delivery vehicle is to be used to designate an approach lane 20 (such as designator SYSDVs 40*a*, 40*b* to be described), bay 48 can contain a low-observable float 70 having a tether 71 coiled on a spool 72. Cover 48*a* can be opened, bay 48 flooded, and tether 71 paid-out as float 70 is buoyed to surface 23*a* of water 23 as described below.

Typically, line charge 50 can be a series of explosive charges 51 connected together in a spaced-apart relationship from one another by flexible cord-like strength members 52. Strength members 52 hold line explosive charges 51 as an elongate unit as it is deployed. A firing means, such as an elongate flexible detonating cord 53 may coextend with strength members 52 to explosive charges 51 to detonate them after line charge 50 has been deployed.

A firing device 54 can be connected to detonating cord 53 and communication/control modules 45 to initiate detonation of line charge at the proper time. Firing device 54 can be located in the components of reel 49 inside storage bay 48 of SYSDV 40. Optionally, line charge 50 can include a redundant firing device located in LCDV 60 (not shown) that could be actuated by radio frequency, acoustic, or other signals and used in the event the primary firing device fails. The redundant firing device located on LCDV 60 can be used in the event there is unused line charge 50 remaining on reel after the deployment process is complete, which will prevent premature severing of detonation cord 53 at reel 49 when the excess line charge detonates.

Line charge 50 has an elongate sac 55 defining an air plenum that can surround and be connected to explosive charges 51, strength members 52, and detonating cord 53.

Elongate sac 55 makes line charge 50 only slightly negatively buoyant when it is in salt water 23. Small flotation blocks (not shown) could be spaced among explosive charges 51 for buoyancy instead of elongate sac 55. The buoyancy feature of elongate sac 55 is important because without it, LCDV 60 may not have sufficient power/traction to drag line charge 50 from reel 49 on SYSDV 40 and pay it out from reel 49 all to way through surf zone 22 and onto beach portion 25. One option is to have each LCDV 60 bring its interconnected line charge 50 to water's edge at low tide, then later at high tide move onto beach portion 25 that is underwater at high tide. Later when the tide recedes to the next low tide condition, the part of beach portion 25 that is now not underwater can be cleared by detonation of each line charge 50. As a further option each LCDV 60 may be made more powerful to be able to drag each line charge 50 through surf zone 23 and across beach 25, but the more powerful LCDVs 60 might have to be larger and consequently may compromise covertness.

LCDV 60 is an autonomous vehicle that will automatically navigate its way from SYSDV 40, through surf zone 22, shoreline 24 and onto beach portion 25 (or close to the beach) using a path 60*a* that can be made perpendicular to shoreline 24. LCDV 60 has several tracked crawler assemblies 62 mounted on it and driving means 64 are coupled to tracked crawler assemblies 62 to impart crawling motion to LCDV 60 as it crawls along exposed floor, or bottom 23*b* under water 23 in surf zone 22 and surface of beach portion 25. Driving means 64 can be functionally the same as motors 43, fuel and/or batteries 44 and communication/control modules 45 of SYSDV 40. However, since the distance LCDV 60 has to travel is less than the distance SYSDV 40 must travel, less fuel or electrical power is required.

LCDV 60 additionally has navigation equipment 66 to successfully navigate through surf zone 22 and beach portion 25 while maintaining the desired path 60*a* to ensure that line charge 50 is properly deployed. Navigation equipment 66 of LCDV 60 includes computer 69 and modules that provide at least the functional equivalent of communication/control modules 45 of SYSDV 40, and an acoustic long baseline receiver 67*a* is coupled to an acoustic transducer 67*b* in addition to a compass, gyroscopes, etc. In addition to receiving second instructions 68 on second computer 69 for a mission from OCS 35 of laptop computer 36 on ship 30, second computer 69 of LCDV 60 runs a Kalman filter to calculate position and heading accurately based on information from these sensors. An antenna 66*a* can be connected to equipment 66 to provide a means of receiving electromagnetic control signals, for example, signals 30*a* from ship 30. Transducer 67*b* provides the capability not only to transmit acoustic signals, but also to receive acoustic control signals 30*b* and other signals, such as LBL navigation signals from transmitter 73.

Components and connections for modules of communication/control modules 45 and modules for navigational equipment 66 and their appropriate interconnection to responsive machinery are well known in the art. Considerable numbers of off-the-shelf units have long been available for model aircraft and boats, unmanned reconnaissance and drone craft, and full-scale marine and aircraft systems. These applications routinely rely on interfacing with numerous navigational aids, such as GPS and acoustic signals to steer a given course to a preset destination. Therefore, having this disclosure before him, one skilled in the art to which this invention pertains is free to choose and appropriately interconnect suitable components freely available in the art.

Line charge 50 is attached at one end to reel 49 and at its opposite end to LCDV 60. Since reel 49 is connected to SYSDV 40, when LCDV 60 leaves bay 48 and exerts a pulling force on line charge 50, line charge 50 is uncoiled from reel 49 and is pulled straight. LCDV 60 proceeds on its way and may stop in surf zone 22 or extend through it and onto beach portion 25. Line charge 50 is pulled straight and trails behind to extend along the distance traveled by LCDV 60. Once LCDV 60 reaches a desired depth in surf zone 22 or the desired distance from SYSDV 40 to shoreline or somewhere on beach portion 25, reel 49 on SYSDV 40 locks and LCDV 60 continues to drive forward until a predetermined tension is created on line charge 50. Once this predetermined tension pulls line charge 50 to a desired degree of tightness, it is straightened out and further progress of LCDV 60 is arrested. SYSDV 40 and LCDV 60 serve as anchors to hold line charge 50 in place along path 60*a* until the time it is detonated.

Figure 3:
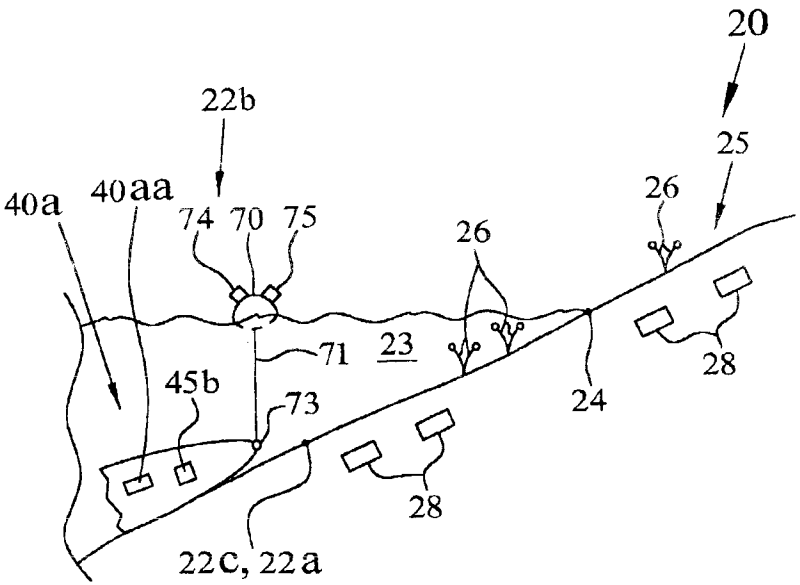
FIG. 3 is a cross-sectional schematic view showing the placement of transducers associated with the acoustic LBL navigational system taken generally along line 3—3 in FIG. 2.
Figure 2:
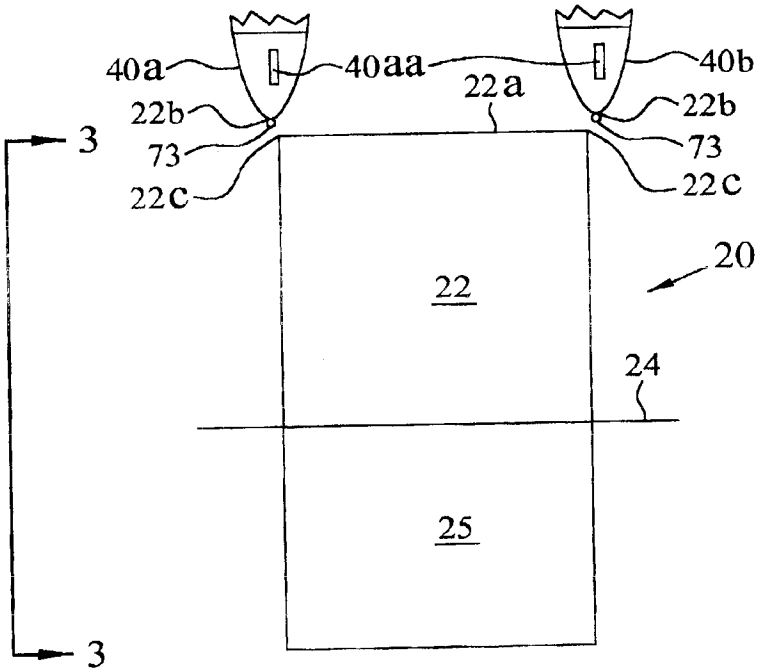
FIG. 2 is a schematic showing the placement of transducers associated with an acoustic long baseline (LBL) navigation system.

Referring additionally to FIGS. 2 and 3, to operationally deploy system 10 an operator, user or planner onboard ship 30 designates a particular approach lane 20 that is to be cleared of obstacles 26 and mines 28. First and a second designator SYSDVs 40*a*, 40*b* are used to place acoustic transmitters 73, which serve as part of the acoustic LBL system and can optionally serve as a repeater for acoustic communications. The designator SYSDVs 40*a*, 40*b* are like SYSDV 40 but do not transport a line charge 50 or LCDV 60. OCS 35 instructs designator SYSDVs 40*a*, 40*b* where to place the acoustic LBL navigation transmitters 73. This deployment of transmitters 73 has operator on ship 30 entering appropriate first instructions 46 from OCS 34 into single board computers in SYSDVs 40*a*, 40*b*. These transmitters 73 are to be placed at seaward corner positions 22*b* seaward of outer corners 22*c* of surf zone 22. of, approach lane 20.

The primary purpose of the two transmitters 73 that are placed at the seaward corner positions 22*b* near seaward edge 22*a* of surf zone 22 (depicted in FIG. 2) is to serve as part of an acoustic long baseline navigation system for the SYSDVs 40 and LCDVs 60. The communications capability of transmitters 73 is also used to relay the results of the transmitter survey (described below) back to ship 30. A secondary purpose would be to use them as a relay/repeater for data communications between the vehicles and the ship and/or as lane markers.

The basic principle of a standard passive acoustic LBL system is as follows:

SYSDVs 40, LCDVs 60 and the two acoustic transmitters 73 are time synchronized, and each contains a highly accurate clock, which minimizes clock drift. The two transmitters 73 are deployed (as shown in FIG. 2) and surveyed using GPS. This task can be accomplished using either divers or the designator SYSDVs 40*a*, 40*b*. Latitude/longitude pairs for the position of each transmitter 73 are acoustically transmitted back to ship 30 from designator SYSDVs 40*a*, 40*b* or if divers are used to deploy the system, the position information is radioed from the divers to ship 30. The position of each LBL navigation transmitter is then provided to each SYSDV 40 and LCDV 60 as part of first instruction 46 and second instruction 68. Each LBL transmission of each transmitter 73 will "chirp" at different intervals (e.g. one transmitter 73 will chirp one second and the other transmitter 73 will chirp the next second, and so on). SYSDVs 40 and LCDVs 60 using the LBL system "listen" for the chirps, and when a chirp is detected the vehicle takes note of the time it was received. The SYSDVs 40 and LCDVs 60 using the LBL system know at what times each transmitter 73 will chirp, so using this information in combination with the time the chirp arrived, the "time of flight" for the chirp can be determined. So, for example, if SYSDV 40 or LCDV 60 knows that one of transmitters 73 was supposed to transmit at time 2025 seconds and it received the chirp at 2025.5 seconds, the time of flight would then be 0.5 seconds. By using the time of flight for the chirps received from each transmitter 73 and the speed of sound in water equation, which is also dependent on water temperature (a temperature sensor is a component of the LBL receiver located in each SYSDV 40 and LCDV 60), each of SYSDVs 40 and LCDVs 60 can determine its distance from each transmitter 73. Since the position of each transmitter 73 has been surveyed, and the distance from each of these two points is known, each of SYSDVs 40 and LCDVs 60 can then determine both their relative and absolute positions using simple trigonometry.

Designator SYSDVs 40*a*, 40*b* leave ship 30 and autonomously transit to the seaward edge 22*a* of surf zone 22 of approach lane 20 in accordance with instructions on their first computers 47. Near seaward edge 22*a*, each SYSDV 40*a*, 40*b* floods ballast tanks 40*aa* and sinks to the bottom to each deploy a long baseline acoustic transmitter 73 and a low-observable float 70 at seaward corner positions 220*b* located just outside of outer corners 22*c* of surf zone 22 of approach lane 20.

Each float 70 is buoyed upward and has depth sensor 74 and a GPS receiver 75 mounted on it to float at surface 23*a*. Tether 71 is paidout from spool 72 on each SYSDV 40*a*, 40*b* at seaward corner positions 22*b* until each depth sensor 74 detects that float 70 has reached surface 23*a*. Spool 72 is rotated to reduce the slack in tether 71, to reduce error that might be attributed to watch circle. GPS receiver 75 on float 70 integrates its position for a given length of time to improve the accuracy of the position survey.

After gathering the needed data, each float is retracted below surface 23*a* to maintain covertness. The position data for each acoustic LBL navigation transmitter 73 located at each seaward corner position 22*b* is acoustically transmitted via transmitters 73 back to ship 30 and to any additional SYSDVs 40 or LCDVs 60 currently in the water. The transmitted data can be incorporated into OCS 35 in computer 36 and included as part of instructions 46 and 68 for other SYSDVs 40 and their associated LCDVs 60 that will require these coordinates to utilize the LBL navigational system to accurately emplace several line charges 50.

Next, the operator on ship 30 enters two latitude/longitude pairs indicating the position of each acoustic LBL transmitter 73 located in designator SYSDVs 40*a*, 40*b* and four additional coordinates representing the corners of approach lane 20 to be cleared into OCS 35. OCS 35 displays a map of the area of approach lane 20 and requests that the user confirms the field layout of approach lane 20.

Another way to get the needed data is contrary to the autonomous procedure described above. Transmitters 73 are deployed using divers that are sent out from ship 30. Divers make their way to the deployment position (seaward corner positions 22*b*), they survey their positions using the global positioning system (GPS), and relay the GPS coordinates of each acoustic LBL navigation transmitter 73 to ship 30. The GPS coordinates are entered into OCS 35 on computer 36 on ship 30 to initialize SYSDVs 40 and LCDVs 60 for clearing of approach lane 20.

Actual clearing of approach lane 20 can now begin in earnest. Computer 36 on ship 30 is coupled to first and second computers 47, 69 on SYSDVs 40 and LCDVs 60, respectively. OCS 35 on computer 36 initializes first and second computers 47, 69 on SYSDVs 40 and LCDVs 60, providing them with first and second instructions 46, 68 containing the field information necessary for them to complete their mission.

Figure 4:
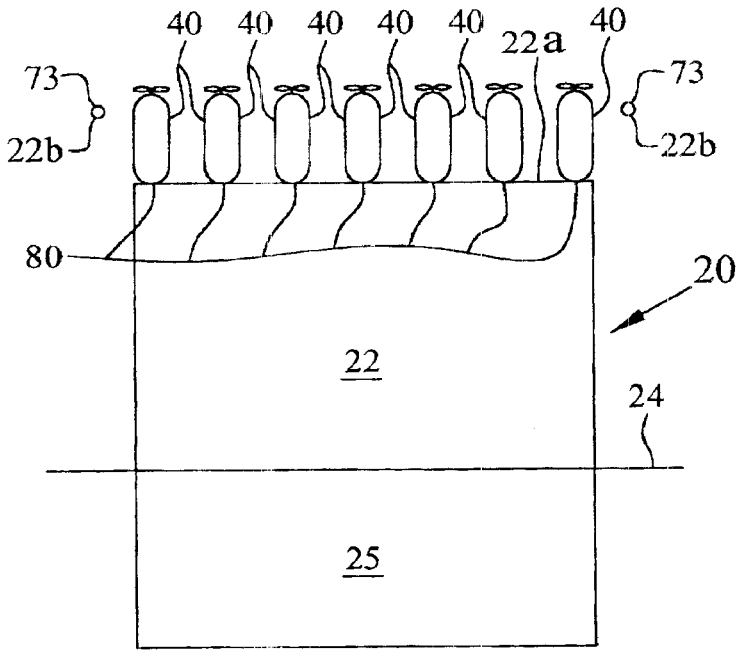
FIG. 4 shows deployment of system delivery vehicles at base positions along the seaward edge of the approach lane.
Figure 5:
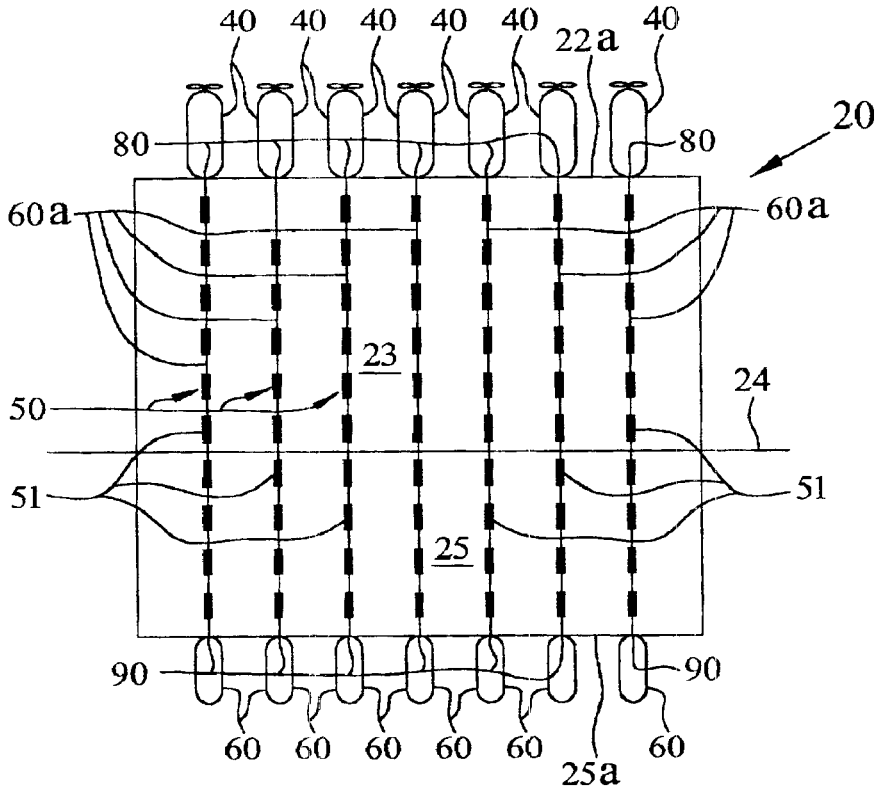
FIG. 5 shows line charge delivery vehicles after pulling line charges from system delivery vehicles and emplacing them in parallel paths in the approach lane.

SYSDVs 40 which contain explosive line charges 50, LCDVs 60, and other system components needed to deploy line charges 50, are deployed, or launched from ship 30. Since each of SYSDVs 40 has different first instructions 46 in their first computers 47, each of SYSDVs 40 transits to arrive at different designated base positions 80 spaced apart from one another in a side-by-side relationship along seaward edge 22*a* of surf zone 22 and approach lane 20 to be cleared, see FIGS. 4 and 5.

At positions 80 first computers 47 of SYSDVs 40 initiate flooding of one or more internal compartments 40*aa* and SYSDVs 40 sink through water 23 to bottom 23*b* of water 23. At a predetermined time that is in accordance with first instructions 46 in first computers 47, covers 48a are rotated open, and bays 48 of SYSDVs 40 are flooded. In accordance with the different second instructions 68 in second computers 69 of each LCDV 60, tracked crawler assemblies 62 of LCDVs 60 in flooded bays 48 are activated and proceed to crawl over opened covers 48*a* and onto bottom 23*b*. Each LCDV 60 pulls on an interconnected line charge 50 that is each wrapped about reel 49 and rotates reel 49 as it drags part of line charge 50 behind. Each reel 49 in each SYSDV 40 continues to rotate as each LCDV 60 unwraps and pulls more and more of its interconnected line charge 50 from its position of coiled stowage. Different second instructions 68 in second computers 69 in each of LCDVs 60 guide each LCDV 60 along a different path 60*a* that are parallel and equal distantly spaced from each other. As each LCDV 60 crawls, or progresses along bottom 23*b* in surf zone 22, each line charge 50 is dragged along and pulled straight to space and emplace explosive charges 51 apart in their predetermined parallel separation in paths 60*a*. Elongate sac 54 on each line charge 50 partially buoys at least part of the load of line charge 50 upward in surf zone 22 to reduce part of the entrained load created by each line charge 50, and the amount of force exerted by crawler assemblies 62.

When only surf zone 22 of approach lane 20 is to be cleared, line charges 50 in paths 60*a* do not have to extend onto beach portion 25 and can be detonated entirely in surf zone 22. First instructions 46 control SYSDVs 40 to allow LCDVs 60 to reach a predetermined destination (e. g. shoreline 24) or depth in surf zone 22. At this predetermined destination, their interconnected reels 49 in SYSDVs 40 are locked to prevent further outward travel of LCDVs 60 that are connected to the opposite ends of line charges 50. Each of these locked-in-place line charges 50 are stretched tight and each interconnected SYSDV 40 and LCDV 60 serve as anchors to hold the stretched line charges 50 in place along paths 60*a*.

Once line charges SO are appropriately stretched along paths 60*a*, LCDVs 60 can be inactivated to allow line charges to remain in place. Line charges 50 emplaced in surf zone 22 can be detonated now or later to clear surf zone 22.

In response to a tactical situation, line charges 50 emplaced in surf zone 22 as described above can remain undetected for a prolonged period of time. Later, coiled portions of line charges 50 remaining on reels 49 in SYSDVs 40 can be utilized to enable extension of line charges 50 so that they can additionally reach across part of beach portion 25 of approach lane 20.

In accordance with a sequence preprogrammed in first instructions 46, the passage of time, or a remote acoustic signal 30*b*, first instructions 46 can unlock SYSDVs 40 to release reels 49 to unwind more of line charges 50 that are still coiled on them. Second instructions 68 reactivate LCDVs 60 to pull line charges 50 to further extend in paths 60*a* parallel with respect to one another across shoreline 24 and partially onto beach portion 25. Line charges 50 extend paths 60*a* equally spaced apart from and parallel with each other throughout surf zone 22 and beach portion 25 of approach lane 20. Detonation of extended line charges 50 can be made in sequences or simultaneously via each firing device 54.

Line charges 50 also can be emplaced throughout surf zone 22 and part of beach portion 25 of approach lane in a single uninterrupted sequence. Emplacement of the entire lengths of line charges 50 need not have a period of time elapse while parts of line charges 50 are extended in surf zone 22. This uninterrupted, continuous sequence can include tightening of emplaced line charges 50 that extend from SYSDVs 40 at seaward base positions 80 at seaward edge 22*a* to LCDVs 60 where they have progressed to inland positions 90 at the inland edge 25*a* of approach lane 20.

First and second instructions 46 and 68 control emplacement of line charges 50 in parallel equally spaced apart distributions 60*a* of explosive charges 51 of line charges 50 in surf zone 22 and beach portion 25. The separations between distributions 60*a* and the spacing between explosive charges 51 assure the creation of an aggregate intense explosive effect to neutralize obstacles 26 and mines 28 (usually by destruction) within approach lane 20 and make approach lane 20 safe for transit of personnel, materials, and vehicles.

In these or other deployment sequences the locations and paths of SYSDVs 40 and LCDVs 60 can be different. The payloads of line charges 50 can be different to include one or more larger explosive charges or instrumentation packages to accomplish some other desired tactical result. Irrespective of the exact configuration of the constituents of system 10 of the invention, it is a covert and fully autonomous means of clearing obstacles and mines in approach lane 20 that is capable of being safely deployed from over-the-horizon and keeping personnel away from danger.

SYSDV 40 could use tracked crawler assemblies 42 in a crawler mode that allow SYSDV 40 to crawl on bottom 23*b* of water 23 to deliver LCDVs 60 and line charges 50. SYSDV 40 could use propeller/fin arrangement 41 in the swimmer-delivery mode that propels SYSDV 40 through water 23 above bottom 23*b* and through water 23 to deliver LCDVs 60 and line charges 50. Both delivery capabilities are schematically depicted for SYSDV 40 and could be used alone or in combination depending on what is found to be the most effective way to successfully complete the mission.

A swimmer-type vehicle could be used instead of a crawler type LCDV 60, but this might limit deployment of line charges 50 to only part of surf zone 22. The clock of GPS could be used to synchronize a passive acoustic LBL navigational system, such as described above to simplify the synchronization process.

Another option is to have all of the navigation components installed only on LCDVs 60 instead of on both LCDVs 60 and SYSDVs 40. The navigation data from such LCDVs 60 would be shared with SYSDVs 40 for use during transit of SYSDVs 40 from ship 30 to approach lane 20 through a temporary umbilical connected to LCDVs 60 in storage bays 48. Having all of the navigational components in LCDVs 60 reduces the overall system cost since all SYSDVs 40 and LCDVs 60 are destroyed at the time of detonation of their emplaced line charges 50.

Having the teachings of this invention in mind, modifications and alternate embodiments of autonomous system 10 may be adapted without departing from the scope of the invention. Its uncomplicated, compact design incorporates structures and technologies long proven to operate successfully in the hostile marine environment. Autonomous system 10 lends itself to numerous modifications to permit its reliable use in different ways for different purposes in hostile and demanding environments both on open water and over many different types of land mass, including but not limited to beaches, hard-pack, soft mud, marsh, tidal flats etc. Autonomous system 10 of the invention can be made larger or smaller in different shapes and fabricated from a wide variety of materials to assure resistance to corrosion, sufficient strength for heavy loads, and long-term reliable operation under a multitude of different operational requirements.

The disclosed components and their arrangements as disclosed herein, all contribute to the novel features of this invention. Autonomous system 10 provides a multipurpose and capable means of emplacing elongates line charges 50 to assure neutralization of obstacles and mines irrespective of ambient conditions and terrain. Therefore, autonomous system 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A system for autonomous clearance of obstacles and mines from an approach lane comprising:

a ship distantly located from an approach lane spanning a surf zone and beach portion, said ship having operator control station software in an onboard computer;

a system delivery vehicle having a storage bay and means to transit from said ship to said approach lane in response to first instructions from said operator control station software;

a line charge disposed in said bay and having one end coupled to said system delivery vehicle; and a line charge delivery vehicle disposed in said bay and connected to another end of said line charge to pull said line charge from said bay and emplace said line charge in a straight path in said approach lane in response to second instructions from said operator control station software.

2. The system of claim 1 wherein said storage bay has a reel mounted on said system delivery vehicle and said line charge is wrapped around said reel in coiled storage during transit to said approach lane.

3. The system of claim 2 wherein said line charge delivery vehicle has tracked crawler assemblies to crawl along a surface to emplace said line charge in an elongate path through said surf zone and beach portion of said approach lane.

4. The system of claim 3 wherein system delivery vehicle has a hinged cover to open and flood said storage bay to permit emplacement of said line charge by said line charge delivery vehicle.

5. The system of claim 4 further comprising:

a first computer in said system delivery vehicle to effect operation thereof in response to said first instructions and a second computer in said line charge delivery vehicle to effect operation thereof in response to said second instructions.

6. The system of claim 5 wherein said line charge has a plurality of explosive charges spaced apart from each other on flexible strength members and an elongate buoyant sac along said explosive charges to reduce the load of said line charge through said surf zone.

7. The system of claim 6 wherein system delivery vehicle has propulsion means including propeller/fin arrangements and tracked ground crawler assemblies to transit from said ship to said approach lane in a swimmer delivery mode and crawler mode, respectively, and motors, fuel/batteries, and communications/control modules are provided to responsively operate said propulsion means.

8. The system of claim 7 wherein said system delivery vehicle and said line charge delivery vehicle exert tension on said line charge to straighten out said line charge along a path.

9. The system of claim 8 further comprising:

means for detonating said explosive charges to clear obstacles and mines from said approach lane.

10. The system of claim 9 further comprising:

a plurality of system delivery vehicles each having a storage bay with a reel therein;

a plurality of line charges; and a plurality of line charge delivery vehicles, each of said system delivery vehicles containing a separate one of said line charge delivery vehicles connected to a separate one of said line charges, each of said line charges being connected to and coiled on a separate reel, each of said plurality of system delivery vehicles having a first computer having different first instructions to position said plurality of system delivery vehicles in side-by-side spaced apart locations along a seaward base portion of said approach lane, each of said line charge delivery vehicles having a second computer having different instructions to open each bay and activate each line charge delivery vehicle to pull a separate line charge from a reel and along a different path in said approach lane.

11. The system of claim 10 wherein said plurality of line charge delivery vehicles emplace said plurality of line charges in said approach lane along parallel equally spaced apart paths.

12. The system of claim 11 wherein each of said plurality of line charges includes explosive charges connected to flexible strength members and a detonating cord and a firing device is suitably connected to detonate said line charge.

13. A method of autonomously clearing obstacles and mines from an approach lane comprising the steps of:

transiting designator vehicles in water from a support ship to seaward corner positions in water outside of an approach lane;

deploying sensors for position and depth at said seaward corner positions in said water outside of said approach lane;

transmitting sensor and position data through said water from said seaward corner positions;

initializing first computers in a plurality of system delivery vehicles with first instructions based partially on said data and second computers in a plurality of line charge delivery vehicles with second instructions at said support ship, said system delivery vehicles each having a storage bay with a reel therein;

containing a separate one of said line charge delivery vehicles and a line charge in each bay, each line charge having one end connected to a separate one of said line charge delivery vehicles and another end connected to a reel and being coiled thereon;

transiting said system delivery vehicles to base positions located along a seaward edge of said approach lane between said seaward corner positions;

rotating covers from each bay;

flooding each bay with water;

deploying a line charge delivery vehicle from each bay;

pulling a line charge behind each line charge delivery vehicle along a separate path in said approach lane; and emplacing all line charges in said approach lane.

14. The method of claim 13 wherein said step of transiting said system delivery vehicles to base positions located along a seaward edge comprises the steps of:

arriving at different designated ones of said base positions by different ones of said system delivery vehicles, said base positions being spaced apart from one another in a side-by-side relationship along said seaward edge of said approach lane; and flooding compartments in said system delivery vehicles to sink said system delivery vehicles to bottom of said water to maintain said spaced apart side-by-side relationship at said base positions.

15. The method of claim 14 wherein said step of deploying said line charge delivery vehicles comprises the step of:

crawling tracked crawler assemblies of each line charge delivery vehicle over open covers and onto and across said bottom.

16. The method of claim 15 wherein said step of pulling comprises the step of:

rotating each reel as each line charge delivery vehicle unwraps and pulls more of each line charge from each reel.

17. The method of claim 16 further comprising the step of:

crawling all line charge delivery vehicles from their base positions along said bottom under a surf zone of said approach lane in paths parallel with each other in said approach lane, each line charge being dragged along and pulled straight to space and emplace explosive charges of each line charge apart in a parallel separation in said paths.

18. The method of claim 17 further comprising the step of:

partially buoying each line array in said surf zone with an elongate sac connected to each line charge to reduce part of the entrained load created by each line charge.

19. The method of claim 18 further comprising the steps of:

locking each reel to prevent further outward travel of each line charge delivery vehicle connected to each line charge;

stretching tight each locked-in-place line charge; and anchoring each stretched tight line charge by each system delivery vehicle and line charge delivery vehicle connected thereto, said step of anchoring holding the stretched line charges in place along said paths.

20. The method of claim 19 further comprising the step of:

extending said step of crawling all line charge delivery vehicles to create continuously extended paths of emplaced line charges across said approach lane from said seaward edge of said surf zone to an inland edge of a beach portion of said approach lane.

21. The method of claim 20 further comprising the step of:

detonating explosive charges in all line charges to clear said approach lane of obstacles and mines.

* * * * *